US012178319B2

(12) United States Patent
Zadro

(10) Patent No.: US 12,178,319 B2
(45) Date of Patent: Dec. 31, 2024

(54) WALL CABINET WITH EXTENDABLE MIRRORED DOOR

(71) Applicant: Zadro, Inc., Huntington Beach, CA (US)

(72) Inventor: Zlatko Zadro, Huntington Beach, CA (US)

(73) Assignee: Zadro, Inc., Huntington Beach, CA (US)

( * ) Notice: Subject to any disclaimer, the term of this patent is extended or adjusted under 35 U.S.C. 154(b) by 0 days.

(21) Appl. No.: 17/664,014

(22) Filed: May 18, 2022

(65) Prior Publication Data

US 2023/0371687 A1 Nov. 23, 2023

(51) Int. Cl.
*A47B 67/02* (2006.01)
*A47B 67/00* (2006.01)

(52) U.S. Cl.
CPC ..... *A47B 67/005* (2013.01); *A47B 67/02* (2013.01)

(58) Field of Classification Search
CPC ..... A47B 67/02; A47B 67/005
USPC ..... 312/227
See application file for complete search history.

(56) References Cited

U.S. PATENT DOCUMENTS 1,750,366 A * 3/1930 Smith ..... A47B 67/02 312/227
3,109,685 A * 11/1963 Skorupa ..... A47B 63/02 312/227
3,140,134 A * 7/1964 Nairn ..... A47K 5/02 312/227
3,771,854 A * 11/1973 Roark ..... A47G 1/04 359/854
4,396,249 A * 8/1983 Aisley ..... A47B 67/005 312/227
4,775,231 A * 10/1988 Granzow ..... G02B 7/1824 359/860
5,399,008 A * 3/1995 Vann, Jr. ..... A47B 67/00 49/168
8,424,982 B1 * 4/2013 Schwartz ..... A47B 67/02 312/227
8,910,402 B2 * 12/2014 Mischel, Jr. ..... G09F 19/14 362/135
10,161,622 B1 * 12/2018 Frazier ..... A45D 42/14
2007/0013278 A1 * 1/2007 Herber ..... A47B 67/005 312/227
2011/0031854 A1 * 2/2011 Schwartz ..... A47B 67/02 312/227

* cited by examiner

*Primary Examiner* — James O Hansen
(74) *Attorney, Agent, or Firm* — UltimatEdge IP Law Group, P.C.; Dean G. Stathakis

(57) ABSTRACT

The present specification discloses a wall cabinet having a cabinet box mounted to a wall, generally behind a bathroom vanity, with a mirrored door coupled to the cabinet box through a linkage frame that permits the linkage frame to rotate about the cabinet box by a first side and the mirrored door to rotate about the second side of the linkage frame. In this way, the mirrored front surface of the mirrored door can be arranged by the user to position the mirrored surface closer and at a better angle to the user. This permits the user to closely view the mirrored front surface while remaining in a more ergonomically correct position, without undue leaning over the vanity. The unique design of the linkage frame permits the user to reach into the interior space of the vanity box when the mirrored door is open relative to the linkage frame.

18 Claims, 7 Drawing Sheets

WALL CABINET WITH EXTENDABLE MIRRORED DOOR

BACKGROUND

The subject of this patent application relates generally to wall cabinets with mirrored doors installed above vanities, floor cabinets, and the like.

Cabinets are used for storage of personal belongings that are desired to be hidden from view. Cabinets can be floor mounted and extend from floor to ceiling or be used as a framework for which a countertop can be supported. Alternatively cabinets (such as medicine cabinets or similar storage solutions) can be wall mounted. Wall cabinets are particularly useful in bathrooms as this solution provides additional storage space as well as freeing up countertop space. Frequently, wall cabinets mounted in the bathroom have a mirrored exterior surface located on the door so that the cabinet can have the dual function of storing a person's personal items and enabling the person to use the mirror in a traditional manner. Such mirrored bathroom wall cabinets have an additional benefit in that additional countertop space is now available that would otherwise be occupied from a standing mirror.

However, while providing an advantage, current mirrored wall cabinets have several disadvantages. For example, users may have difficulties properly seeing their reflection due to the wall cabinet being mounted either on the side wall (i.e., the wall to the left or right of the sink) or on the back wall (i.e., the wall behind the sink). In either location, the viewing angle and/or distance is awkward for the user. Additionally, mirrored wall cabinets typically do not have lighting making close-up or precise activities like applying makeup, shaving, or placing contact lens more difficult to perform. The end result is that users generally obtain a standing lighted vanity mirror for such activities, which is place on the countertop and thus eliminating the primary advantage of a wall cabinet in the first place.

What is needed is a system that permits viewing of the mirror's reflection in a closer and less oblique manner while optionally providing a lighting system useful for many of the activities performed in a bathroom. Aspects of the present invention fulfill these needs and provide further related advantages as described in the following summary.

SUMMARY

Aspects of the present invention teach certain benefits in construction and use which give rise to the exemplary advantages described below.

The present specification discloses a wall cabinet comprising a cabinet box, a linkage frame, a first hinge a cabinet door, and a second hinge. The cabinet box includes a cabinet opening for access into an interior space and a first side portion opposite a second side portion. The linkage frame includes a first frame side opposite a second frame side. The first hinge rotatably couples the first frame side of the linkage frame to the first side portion of the cabinet box enabling the linkage frame to selectively rotate away from and towards proximity to the cabinet box. The cabinet door includes a front face opposite a back face and a first door side opposite a second door side. The second hinge rotatably couples the second door side of the cabinet door to the second frame side of the linkage frame enabling the cabinet door to selectively rotate away from and towards proximity to the linkage frame, the second hinge being mounted to the linkage frame opposite the first hinge.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings, which are incorporated in and constitute a part of this specification, illustrate aspects of the disclosed subject matter in at least one of its exemplary embodiments, which are further defined in detail in the following description. Features, elements, and aspects of the disclosure are referenced by numerals with like numerals in different drawings representing the same, equivalent, or similar features, elements, or aspects, in accordance with one or more embodiments. The drawings are not necessarily to scale, emphasis instead being placed upon illustrating the principles herein described and provided by exemplary embodiments of the invention. In such drawings.

Figure 2:
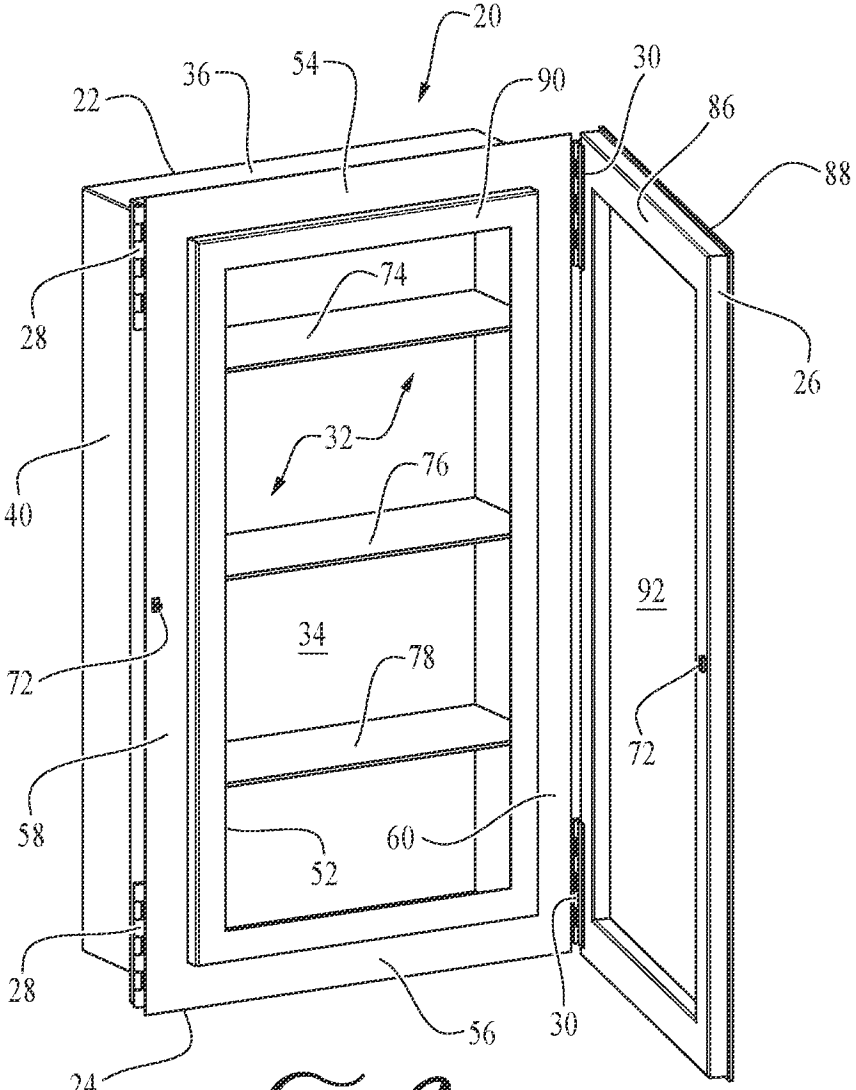
FIG. 2 is an assembled front perspective view of the wall cabinet of FIG. 1, illustrating the wall cabinet in the first open configuration.

Listing of Reference Numbers Associated with Drawings

| Ref. No. | Element |
|---|---|
| 20 | Wall cabinet |
| 22 | Cabinet box |
| 24 | Linkage frame |
| 26 | Cabinet door |
| 28 | First hinge |
| 30 | Second hinge |
| 32 | Interior space |
| 34 | Back wall |
| 36 | Top wall |
| 38 | Bottom wall |
| 40 | First side wall |
| 42 | Second side wall |
| 44 | Face frame |
| 46 | Cabinet opening |
| 48 | First side portion |
| 50 | Second side portion |
| 52 | Frame opening |
| 54 | Frame top |
| 56 | Frame bottom |
| 58 | First frame side |
| 60 | Second frame side |
| 62 | Mirrored front face |
| 64 | Back face |
| 66 | First door side |
| 68 | Second door side |
| 70 | First catch mechanism |
| 72 | Second catch mechanism |
| 74, 76, 78 | Shelf |
| 80, 82, 84 | Shelf bracket |
| 86 | Door frame |
| 88 | Mirror |
| 90 | Offset step |
| 92 | Recess |
| 94 | Side wall |
| 96 | Front wall |
| 98 | Base plate |
| 100 | Flange |
| 102 | Mirror support surface |
| 104 | Light source |
| 106 | Edge portion |
| 108 | Light channel |
| 110 | Back wall |
| 112 | Innermost wall |
| 114 | Outermost wall |
| 116, 118 | Cable |
| 120 | Ribbon cable |
| 122 | Emitted light |
| B | Back wall |
| S | Side wall |
| V | Vanity |
| T | Vanity top |
| E | Vanity top front edge |
| B | Sink basin |
| M | Mirror |

DETAILED DESCRIPTION

The detailed descriptions set forth below in connection with the appended drawings are intended as a description of embodiments of the invention, and is not intended to represent the only forms in which the present invention may be constructed and/or utilized. The descriptions set forth the structure and the sequence of steps for constructing and operating the invention in connection with the illustrated embodiments. It is to be understood, however, that the same or equivalent structures and steps may be accomplished by different embodiments that are also intended to be encompassed within the spirit and scope of the invention.

The present specification discloses a wall cabinet having a cabinet box mounted to a wall, generally behind a bathroom vanity, with a mirrored door coupled to the cabinet box through a linkage frame that permits the linkage frame to rotate about the cabinet box by a first side and the mirrored door to rotate about the second side of the linkage frame. In this way, the mirrored front surface of the mirrored door can be arranged by the user to position the mirrored surface closer and at a better angle to the user. This permits the user to closely view the mirrored front surface while remaining in a more ergonomically correct position, without undue leaning or bending over the vanity. In addition, the closer positioning of the mirrored surface to the user provides a more comfortable viewing distance and superior viewing functionality as compared to magnified mirrors which require the user to be very close to the focal length of the mirror which makes many of the activities a user performs in front of a mirror difficult to execute. Further, the unique design of the linkage frame permits the user to reach into the interior space of the vanity box when the mirrored door is open relative to the linkage frame.

Referring first to FIGS. 1-6, an example embodiment of the present wall cabinet 20 is illustrated, and generally includes a cabinet box 22, a linkage frame 24 firstly hinged to the cabinet box 22, and oppositely hinged on the linkage frame 24 is a cabinet door 26 to form a Z-like or zig-zag pattern of the connected cabinet box 22, linkage frame 24, and cabinet door 26 when viewed from above (i.e., from a viewpoint parallel to the axes of rotation of the hinges), for the purpose of bringing the mirrored surface 62 at a less oblique angle and closer in proximity to the user viewing their reflection.

The cabinet box 22, linkage frame 24, and cabinet door 26 are generally made from sheet metal stamped and/or formed into the final shape and may be welded or otherwise fastened. For example, the cabinet box 22 can be formed from a steel or aluminum sheet of material on a press brake, to form the back wall 34, the top wall 36 adjacent to the back wall 34, the bottom wall 38 adjacent to the back wall 34 and opposite the top wall 36, the first sidewall 40 adjacent to the back wall 34 and spanning between the top wall 36 and the bottom wall 38, and the second sidewall 40 opposite the first side wall 40 and adjacent to the back wall 34 and spanning between the top wall 36 and the bottom wall 38. Further formed by the press brake or other process is the U-channel shaped face frame 44, which, in one or more embodiments, serves to cover the edges of the rough opening (if the wall cabinet 20 is installed as a recessed unit rather than a surface mount unit, either of which is possible) and to support the first hinge(s) 28. After the cabinet box 22 is formed, the adjoining edges of the sheet metal can be welded or fastened together, such as by spot welding, by seam welding, by threaded fasteners, rivets, by tab and slot engagement, or other known joining techniques. Alternatively, the cabinet box 22 (and other components) can be made from plastic using known plastic fabricating techniques.

In one or more embodiments, the back wall 34, the top wall 36, the bottom wall 38, the first side wall 40, and the second sidewall 40 define, at least partially, an interior space 32 with a cabinet opening 46 defined by the face frame 44. Tab pairs protruding from each of the first side wall 40 and the second sidewall 40 form opposing and level shelf bracket pairs or shelf supports 80, 82, 84, each for supporting thereon a shelf 74, 76, 78. Instead of tabs or brackets, the shelf supports 80, 82, 84 can be notches or other indentations formed into or through the first side wall 40 and the second sidewall 40 that are configured to support the shelves 74, 76, 78. Of course, the bottom wall 38 can serve as a bottom shelf.

As described briefly above, the face frame 44 is generally made by bending the leading edges of the top wall 36, the bottom wall 38, the first side wall 40, and the second sidewall 40 into a U-channel for both aesthetic proposes and to provide a rigid support for mounting the linkage frame 24 thereon and for supporting the weight and moment of the cabinet door 26 hinged on the linkage frame 24. In the illustrated example embodiment, one or more hinges 38 are secured to a first side portion 48 of the cabinet box 22, which, in this example, is the left side of the face frame 44. The example hinges 38 are two simple butt hinges. However, a single piano hinge or any hinge arrangement or hardware that permits the linkage frame 24 to rotate about the face frame 44 of the cabinet box 22.

Looking more closely at the linkage frame 24, it is illustrated in this example embodiment as being rectangular and generally matching the dimensions and shape of the cabinet box 22. However, the linkage frame 24 and cabinet door 26 (and, optionally, the cabinet box 22) can be modified according to the desired size and shape. For example, the linkage frame 24 and/or the cabinet door 26 can be circular, oval, include arced edges, etc. In this example embodiment, the linkage frame 24 is shown as being sized and shaped substantially similar to the rectangular cabinet door 26 and the rectangular face frame 44. The linkage frame 24 here includes a frame top 54 opposite a frame bottom 56 and a first frame side 58 opposite the second frame side 60, which together define a frame opening 52. About the frame opening 52 is a stiffening or strengthening feature bent or otherwise fabricated in the form of a offset step 90 that protrudes from the base plate 98 of the linkage frame 24, and comprises a side wall plate 94 extending normally or transversely from the base plate 98 and a front wall plate 96 extending from the side wall plate 94 substantially parallel (e.g., within 20 degrees of parallel in one or more embodiments) to the base plate 98 to form a Z-bar like cross-sectional pattern. Other cross-sectional patterns are also possible that provide sufficient stiffness to support the load of the cabinet door 26 even when the cabinet door 26 is positioned the maximum distance from the cabinet box 22, which is generally the width of the linkage frame 24 or the distance between the first hinge 28 and the second hinge 30.

In the illustrated example embodiment, the linkage frame 24 is a four-sided structure that encloses and defines a frame opening 52, for permitting access by the user to the interior space 32 of the cabinet box 22. However, the linkage frame 24 can take many forms depending on the requirements of the engineering and aesthetic designs. For example, in one or more example embodiments, the first frame side 58 and the second frame side 60 can be eliminated mostly or entirely, leaving just the frame top 54 and the frame bottom 56 (or substantially structurally equivalent linkages), each separately providing a link between the cabinet box 22 and the cabinet door 26 through hinges 28 and 30. The linkage frame 24 as illustrated provides additional rigidity and strength, without requiring heavy-duty joints and linkage members as the proposed alternate embodiment, which saves weight and expense. Still however, the alternate embodiment may be more suitable for certain arrangements, depending on the design requirements.

Looking now at the construction of the cabinet door 26, in the illustrated example embodiment, it is formed of stamped sheet metal with a flange 100 formed about the perimeter of the door frame 86 with a rectangular recess 92 sized and configured to receive nested therein the offset step 90 of the linkage frame 24, to provide stiffening to the door frame 86 and to permit a lower profile arrangement when closed. On the protruding side of the recess 92 is the mirror support face 102. The mirror 88 is secured to the door frame 86, for example, by adhering it to the mirror support face 102, with the perimetral flange 100 configured to cover the edge of the mirror 88 to provide support for the mirror 88 and to located the mirror 88.

The present wall cabinet 20 is an assembly of components, including the cabinet box 22, the linkage frame 24, and the cabinet door 26, secured to one another through hinges. The linkage frame 24 is rotatably mounted to the first side portion 48 of the cabinet box 22 through first hinge 28. In the illustrated example embodiment, the first side portion 48 is the face frame 44 to left side of the illustration. However, use of the terms first side portion 48 and second side portion 50 (which is opposite the first side portion 48) does not indicate a right side or a left side, specifically, of the cabinet box 22. For example, the term first side portion 48 merely indicates that the hinges are mounted on a portion or part of the cabinet box 22 generally located on a first side which is oppositely located from the second side, whether the first side is on the right or left of the viewer.

Here, first hinge 28 (or hinges, in this example) is mounted on the first side portion 48, and more specifically, the face frame 44 adjacent to the first side wall 40. The first hinges 28 are fastened, welded, riveted, or otherwise mounted to the face frame 44 by one leaf. The opposite free leaf of hinges 28 are mounted to the first frame side 58 of the linkage frame 24, such that the linkage frame 24 is permitted to freely rotate about the first hinges 28.

Then, the cabinet door 26 is rotatably mounted to the second frame side 60 of the linkage frame 24 through second hinges 30. A first leaf of the second hinges 30 are fastened, welded, riveted, or otherwise mounted to the second frame side 60 of the linkage frame 24, positioned on the linkage frame 24 opposite to second hinges 30. The opposite free leaf of second hinges 30 are mounted to the second door side 68 of the cabinet door 26, such that the cabinet door 26 is permitted to freely rotate about the second hinges 30.

With the first hinges 28 mounted on an opposite side of the linkage frame 24 to the second hinges 30, where the linkage frame 24 connects or links the cabinet door 26 to the cabinet box 22, the cabinet door 26 and linkage frame 24 can be open and closed (or otherwise arranged) in a variety of configurations, as described directly below. Each of these configurations have advantages and permit the user to adjust the angle to and distance of the mirrored front face 62 from themself, while permitting selective access to the interior space of the wall cabinet 20.

Figure 1:
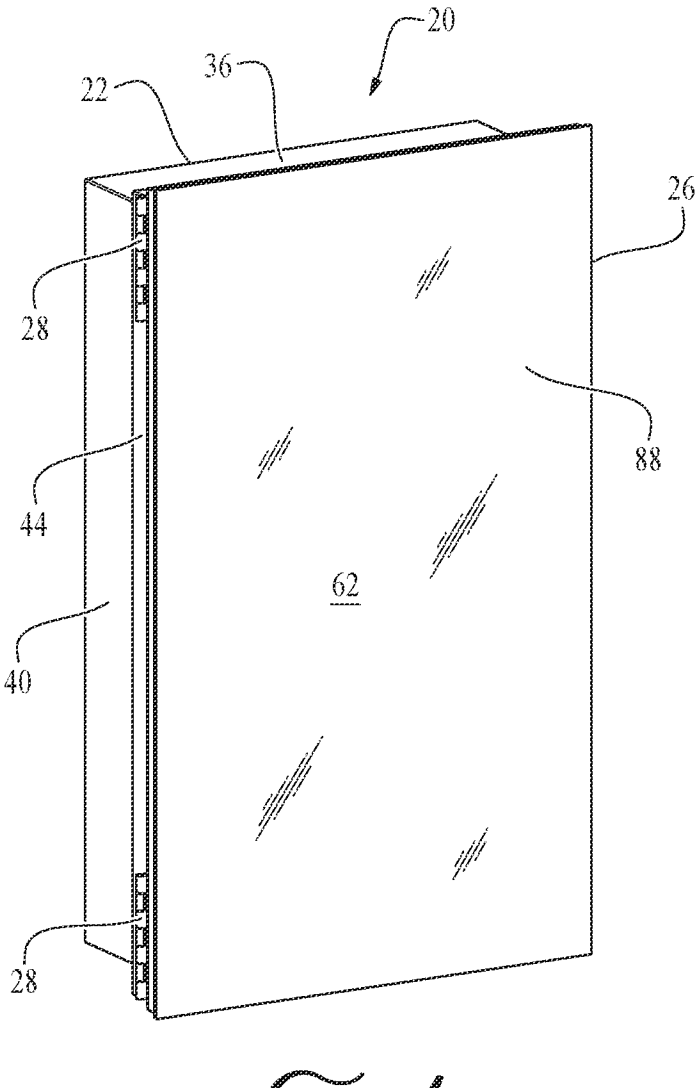
FIG. 1 is an assembled front perspective view of an exemplary embodiment of a wall cabinet disclosed herein, illustrating the wall cabinet in the closed configuration.
Figure 5:
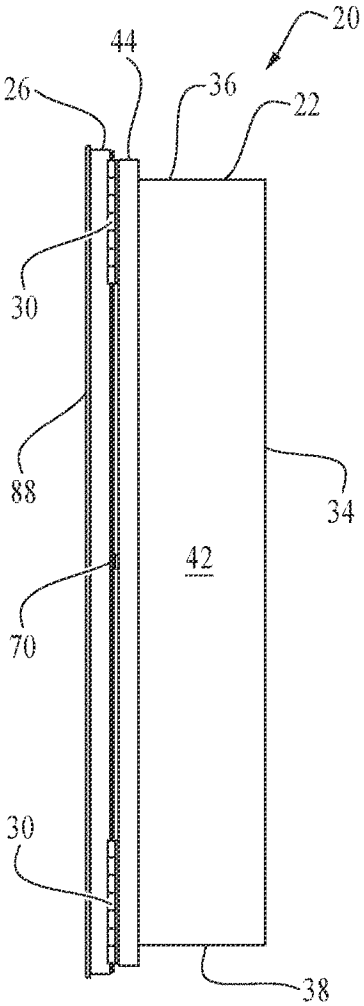
FIG. 5 is a right side view of the wall cabinet of FIG. 1, illustrating the wall cabinet in the closed configuration.
Figure 4:
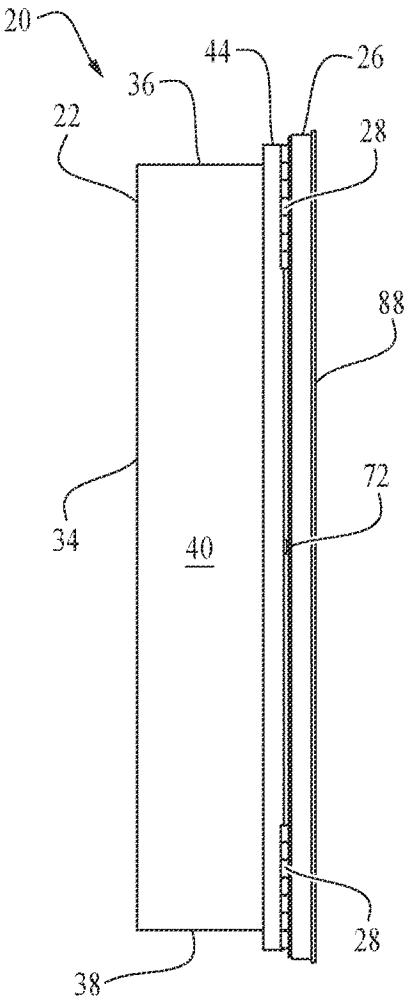
FIG. 4 is a left side view of the wall cabinet of FIG. 1, illustrating the wall cabinet in the closed configuration.

FIG. 1 illustrates the wall cabinet 20 in the closed configuration, where the second frame side 60 of the linkage frame 24 is substantially proximal to the second side portion 50 of the cabinet box 22, and the first door side 66 of the cabinet door 26 is substantially proximal to the first frame side 58 of the linkage frame 24.

FIG. 2 illustrates the wall cabinet 20 in the first open configuration, where the second frame side 60 of the linkage frame 24 is substantially proximal to the second side portion 50 of the cabinet box 22, and the first door side 66 of the cabinet door 26 is rotated away from the first frame side 58 of the linkage frame 24.

Figure 3:
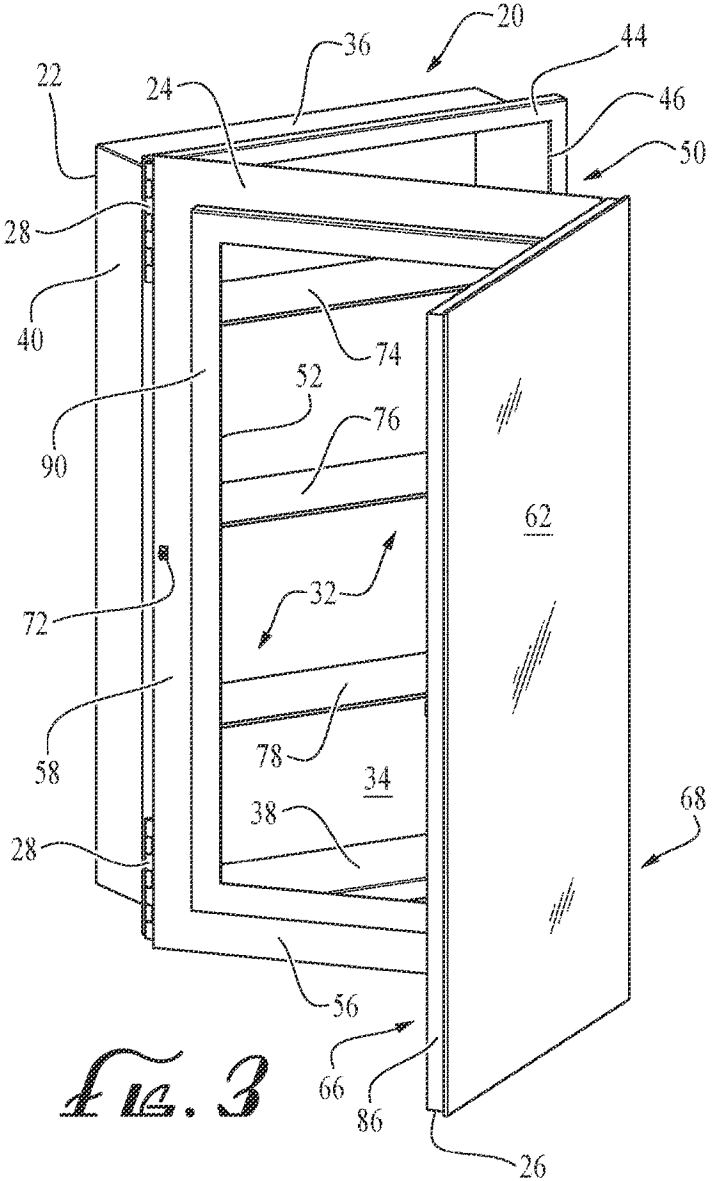
FIG. 3 is an assembled front perspective view of the wall cabinet of FIG. 1, illustrating the wall cabinet in the second open configuration.
Figure 6:
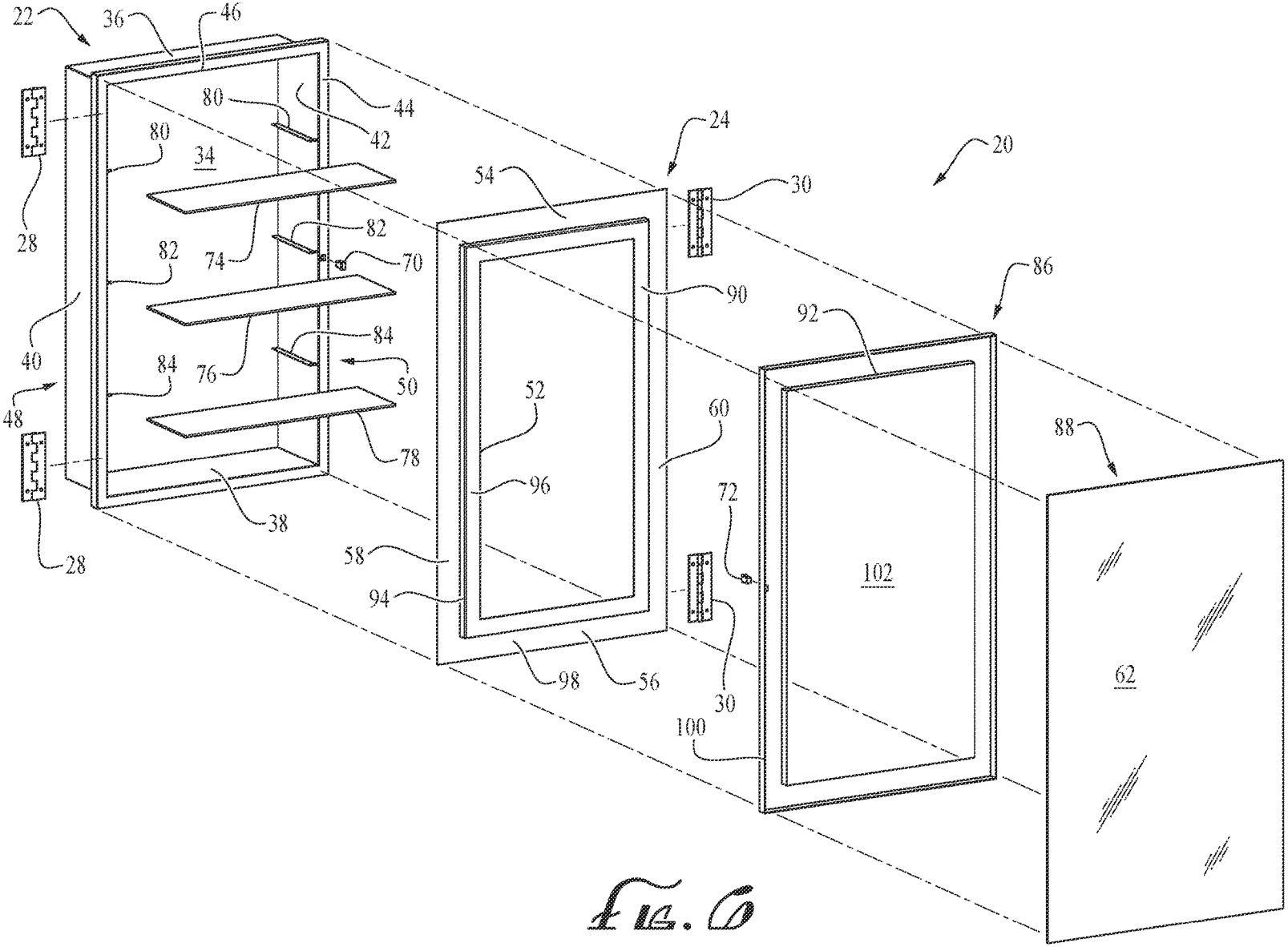
FIG. 6 is an exploded perspective view of the wall cabinet of FIG. 1.

FIG. 3 illustrates the wall cabinet 20 in the second open configuration, where the second frame side 60 of the linkage frame 24 is rotated away from the second side portion 50 of the cabinet box 22 and the first door side 66 of the cabinet door 26 is rotated away from the first frame side 58 of the linkage frame 24.

Figure 7C:
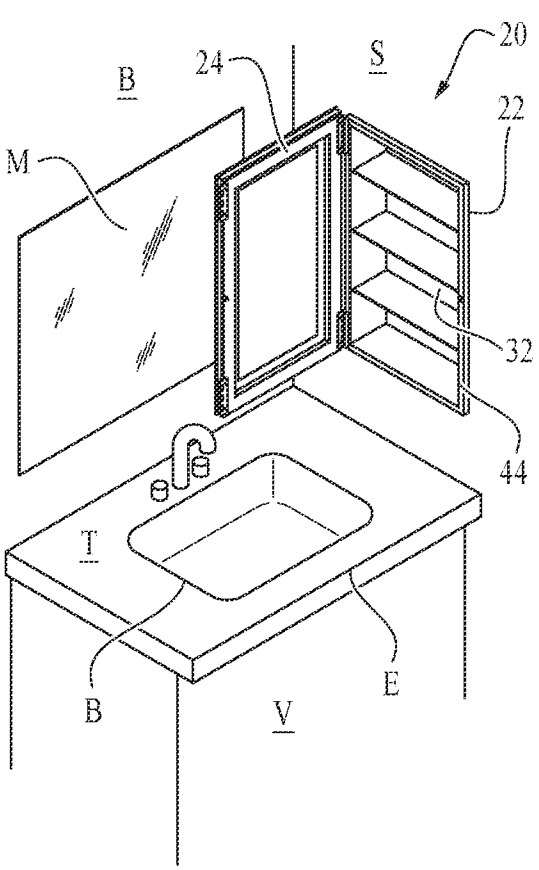
FIG. 7C is a perspective view of the wall cabinet of FIG. 7A, installed on the side wall above a bathroom vanity, in the third open configuration.

FIG. 7C illustrates the wall cabinet 20 in the third open configuration, where the second frame side 60 of the linkage frame 24 is rotated away from the second side portion 50 of the cabinet box 22 and the first door side 66 of the cabinet door 26 is substantially proximal to the first frame side 58 of the linkage frame 24.

Figure 7B:
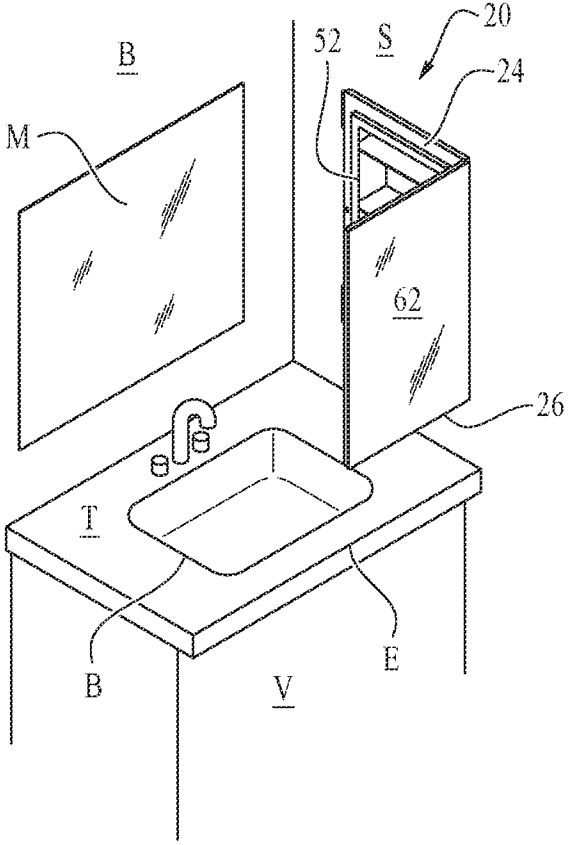
FIG. 7B is a perspective view of the wall cabinet of FIG. 7A, installed on the side wall above a bathroom vanity, in the first open configuration.
Figure 7A:
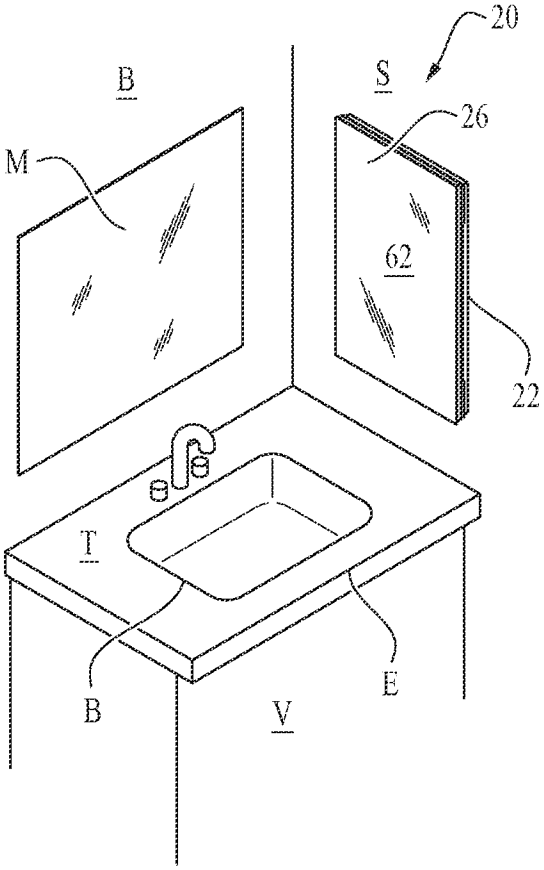
FIG. 7A is a perspective view of the wall cabinet of FIG. 1, installed on a side wall above a bathroom vanity, in the closed configuration.

In FIGS. 7A-C, the present wall cabinet 20 is illustrated as being installed as a recessed mounted unit on the side wall S above a bathroom vanity V. The back wall B includes a standard mirror M adhered thereto. The vanity V includes a vanity top T with a front edge E and a wash basin B. Neither mirror M or 62 (as shown in FIG. 7A in the closed configuration) are positioned ideally for personal use, such as the application of cosmetics or other personal care performed in front of a mirror. The standard mirror M is positioned too far away from the user, who must lean past the front edge E of the vanity top T in order to gain a good view of the face. The mirrored front face 62 of the wall cabinet 20 in FIG. 7A is parallel to the side wall S and must be rotated or otherwise move to position it in a more ideal orientation and location relative to the front edge E of the vanity top T, such that the user needs not lean too far past the edge E to view themself.

In FIG. 7B, the cabinet door 26 of the wall cabinet 20 is in the first open configuration, where the mirrored front face 62 is substantially perpendicular to the side wall S and substantially parallel to the front edge E of the vanity V. The user would grasp the first door side 66 of the cabinet door 26 and apply sufficient force to overcome the holding force of the second catch mechanism 72, In this configuration, the user can comfortably sit or stand behind the edge in an ergonomic upright position while looking closely at the mirrored front face 62. If the user wishes, the cabinet door 26 can be positioned at an angle greater than or less than ninety degrees to the side wall S. Additionally, the user can open the cabinet door 26 slightly more than illustrated to gain access to the interior space 32 by reaching through frame opening 52. Further, in FIG. 7C, if the user simply wishes to access the interior space 32 while not looking at the mirrored front face 62, they merely need to open both the cabinet door 26 and the linkage frame 24 by overcoming the holding force of the first catch mechanism 70, to place the third open configuration.

Figure 8C:
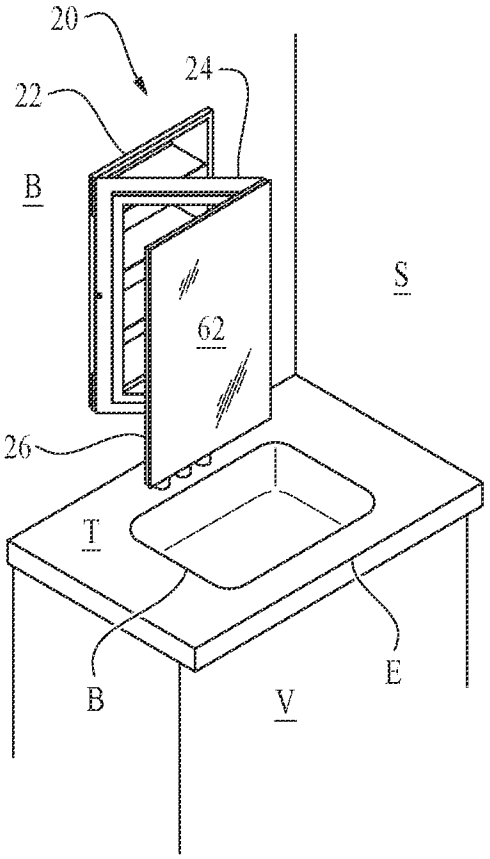
FIG. 8C is a perspective view of the wall cabinet of FIG. 8A, installed on the side wall above a bathroom vanity, in the second open configuration.
Figure 8B:
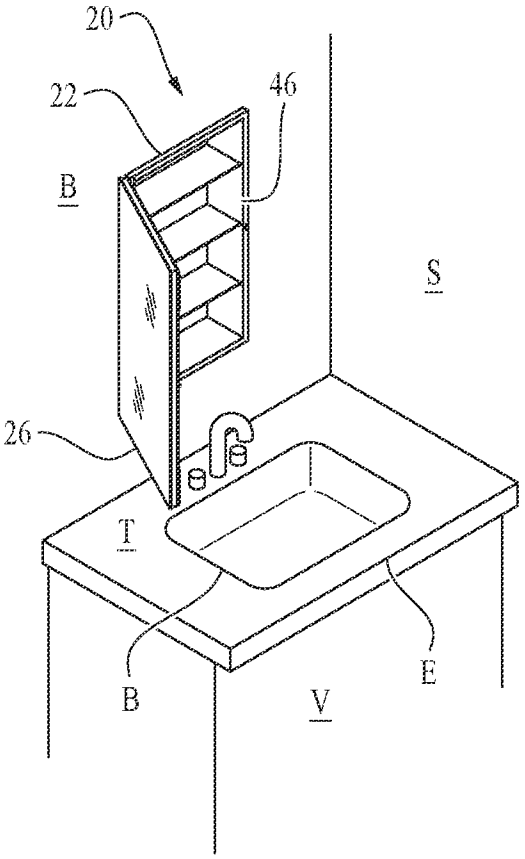
FIG. 8B is a perspective view of the wall cabinet of FIG. 8A, installed on the side wall above a bathroom vanity, in the first open configuration.
Figure 8A:
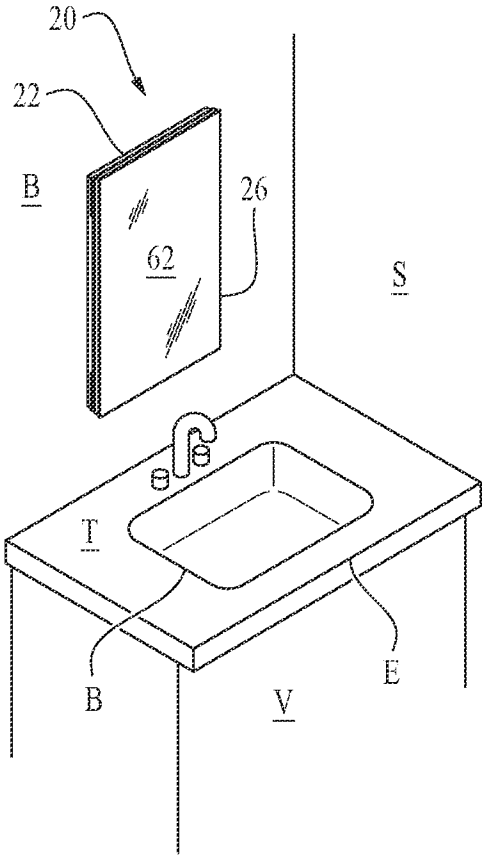
FIG. 8A is a perspective view of the wall cabinet of FIG. 1, installed on a back wall above a bathroom vanity, in the closed configuration.

In FIGS. 8A-C, the present wall cabinet 20 is illustrated as being installed as a recessed mounted unit on the back wall B above a bathroom vanity V. The vanity V includes a vanity top T with a front edge E and a wash basin B. When in the closed configuration of FIG. 8A, the mirrored front face 62 is positioned too far away from the user, who must lean past the front edge E of the vanity top T in order to gain a good view of the face. Much like in FIG. 7C, the cabinet door 26 and the linkage frame 24 can be opened together to transition to the third open configuration. In order to place the mirrored front face 62 closer to the front edge E of the vanity top T, the user can transition the cabinet door 26 and the linkage frame 24 into the second open configuration, where the mirrored front face 62 is brought closer and substantially parallel to the front edge E of the vanity top T, so that the user can closely view the mirrored front face 62 without undue leaning over the vanity top T. In the illustrated embodiment, the maximum distance the cabinet door 26 can be brought forward of the face frame 44 is approximately equal to width (e.g., the length of the frame bottom 56 plus the clearance for the hinges) of the linkage frame 24, when the linkage frame 24 is approximately perpendicular to the face frame 44. Thus, the width of the wall cabinet 20 and the linkage frame 24 can be chosen based on the depth of the vanity top T (i.e., the distance from the back wall B to the front edge E). In one or more alternate embodiments, the linkage frame 24 can telescopically extend (not illustrated) to increase the travel distance.

Figure 10:
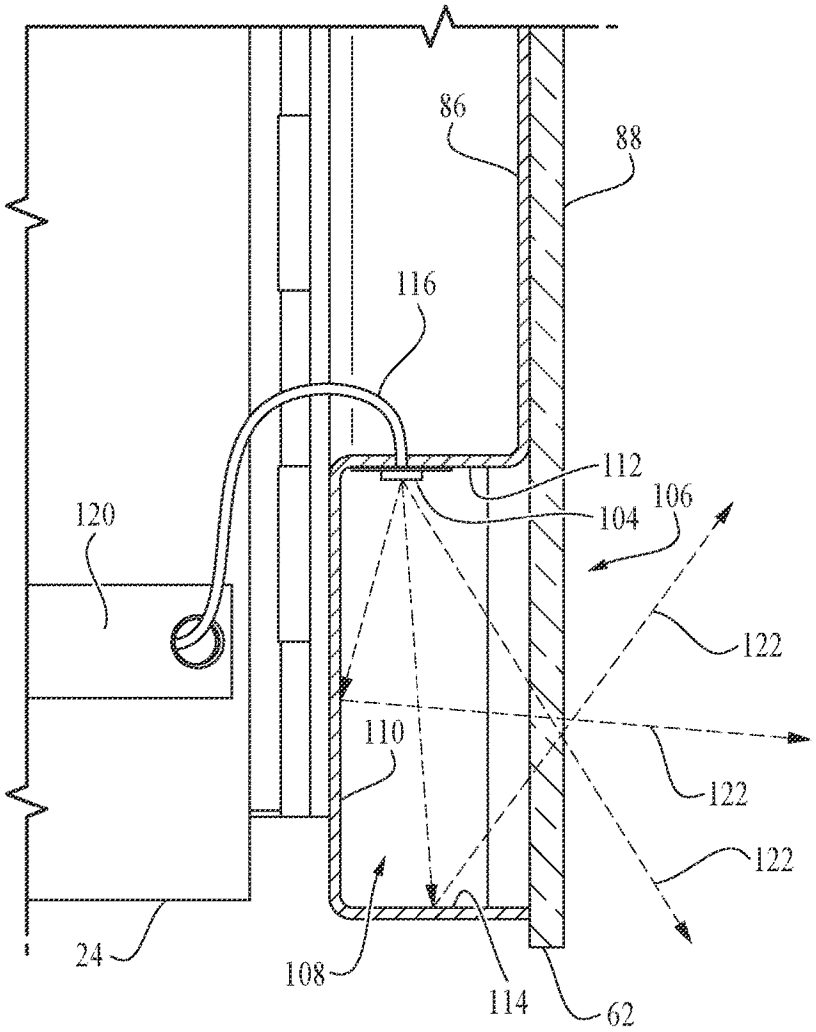
FIG. 10 is a magnified cross-sectional view of the wall cabinet of FIG. 9, illustrating the light channel formed in the mirror support surface within which the light source is mounted.
Figure 9:
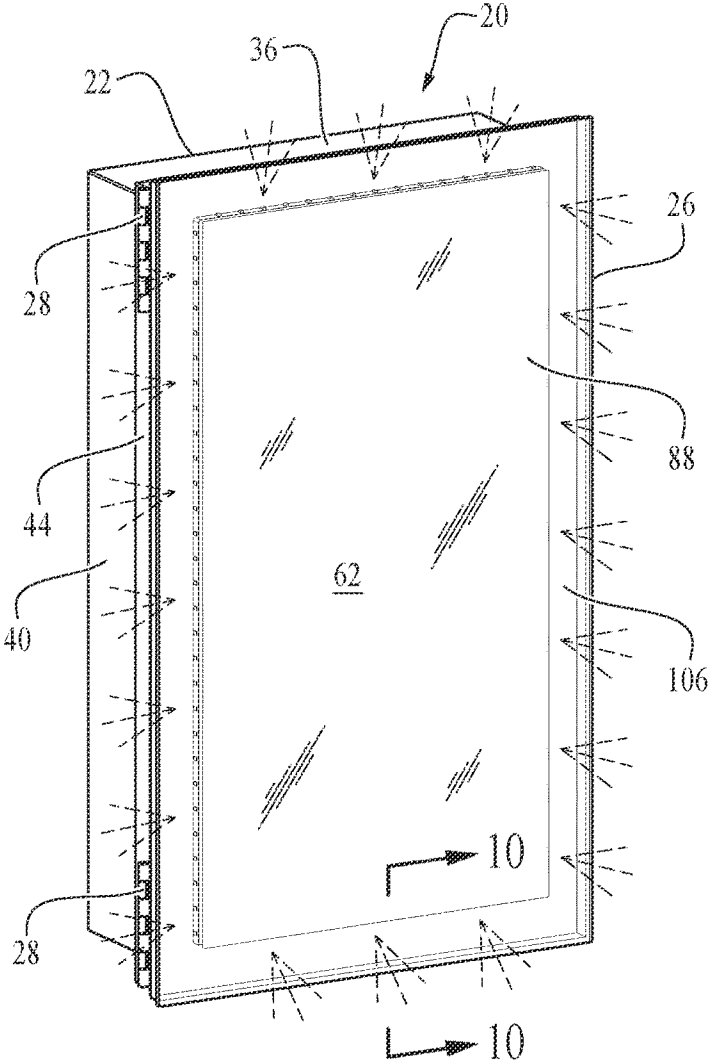
FIG. 9 is an assembled front perspective view of another exemplary embodiment of a wall cabinet disclosed herein, illustrating the wall cabinet in the closed configuration with the mirror illuminated about the edge portions.
Figure 11:
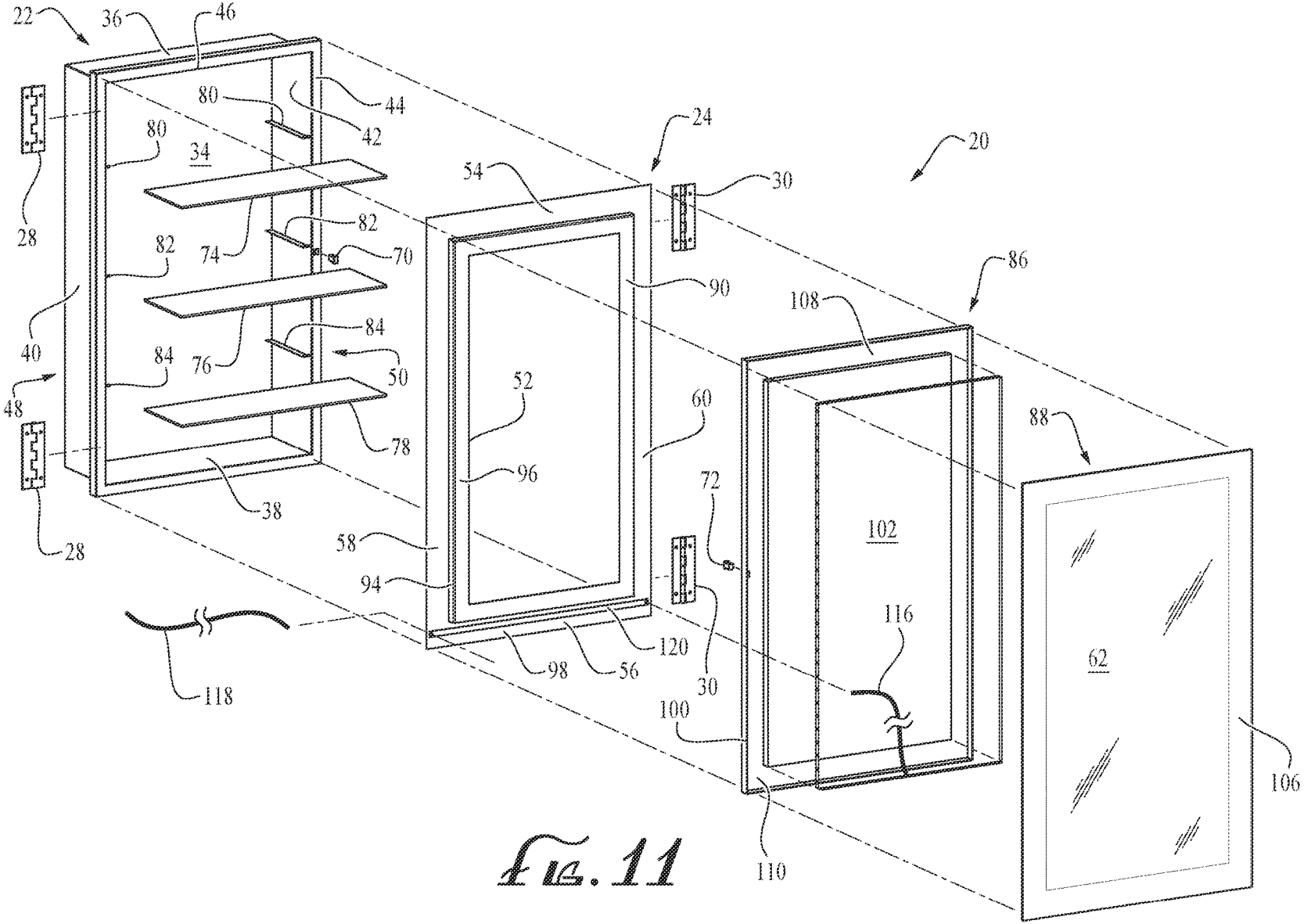
FIG. 11 is an exploded perspective view of the wall cabinet of FIG. 9.

FIGS. 9-11 illustrates another embodiment that includes an illuminated mirror 88'. In FIGS. 9 and 10, the front surface 62 of the mirror 88' includes an edge portion 106, which is a path about the perimeter of the mirror 88' approximately several inches in width, but may be up to 1 inch in width, or up to 2 inches in width, or up to 3 inches in width, or up to 4 inches in width, or up to 5 inches in width, or greater depending on the mirrored field area required for the mirror 88' and the amount of illumination required or desired in a particular application. The edge portion 106 is formed on the mirror 88' by applying less reflective material in the regions of the mirror 88' back through which light is intended to shine (e.g., such as applying a lower density silvering or half-silvering in the edge portion 106). Alternatively (or in addition to the half-silvering techniques), all or part of the edge portion can be frosted to change one or more qualities of the emitted light 122, such as to diffuse the light from the light source 104, to change the color temperature of the light, to change the luminosity of the light, and so on.

Looking more closely at FIG. 10, in one or more embodiments, the light source 104 is a LED strip secured within the light channel 108 (the recess 92 of the embodiment of FIG. 1) of the door frame 86. The light channel 108 in this example embodiment is a rectangular recess formed about the perimeter of the door frame 86 (usually formed in the stamping process for sheet metal), with an innermost wall 112 opposite an outermost wall 114 (i.e., nearest the outer edge of the door frame 86 with a back wall 110 spanning between the innermost wall 112 and the outermost wall 114. The back wall 110 is spaced apart from and generally parallel to the mirror 88'. The LED strip 104 is illustrated as being mounted to the innermost wall 112 to create an edge lit like arrangement (e.g., where a portion of the light emitted from the LED strip 104 is emitted in a direction generally parallel with or at least not normal to the mirror 88'). Of course, the LED strip 104 can be placed on the back wall 110 or on the outermost wall 114 for varying light effects, if desired. Placing the LED strip on the innermost wall 112 tends to limit the amount of direct light and maximize the amount of reflected light comprising the emitted light 112. Within the light channel 108, the walls 110, 112, 114 can be painted white (or other appropriate color or reflective surface) to increase the amount of reflected light from the LED strip 104, resulting in a more diffuse emitted light 112 preferred by many for viewing the mirror 88'.

The electrical signal for powering and/or controlling the LED strip can be carried by a combination of all or one or more of the cables 116, 118 and the ribbon cable 120 to which the cables 116, 118 connect to on either end to transmit the electrical signal between a source (e.g., a control unit, low voltage power source, etc.) and the light source 104. In one or more embodiments, for safety and ease of installation, the power source is low voltage, such that the signal can be transmitted through the relatively thin ribbon cable 120 that is installed, for example, on the linkage frame 24, sandwiched between the linkage frame 24 and the cabinet door 26 (as illustrated) or between the linkage frame 24 and the cabinet box 22. Alternatively, in the place of a ribbon cable 120, the cables 116, 118 (as a single cable) can be installed on the linkage frame 24 within a groove, through a low-profile wire channel, or by other means to create a low-profile installation, as to not interfere with the closure of the cabinet 20. In yet other embodiments, a low-voltage electrical signal can be transmitted between the cabinet door 26, the linkage frame 24, and the cabinet door 26 via a ribbon cable extending across the width of the linkage frame 24, providing electrical communication from hinge 28 to hinge 30, where the positive signal is carried from a power source, through a first cable, through hinge 28, through the ribbon cable, through hinge 30, through a second cable, and to the light source 104. The hinges 28 and 30 can be electrically isolated from the remainder of the wall cabinet 20 through insulation. Additionally, If the bottom hinges are used for transmitted a positive signal, separate top hinges can be used for the ground (or vice versa).

Aspects of the present specification may also be described by the following embodiments:

1. A wall cabinet comprising a cabinet box with an interior space defined by a back wall, a top wall opposite a bottom wall, and a first side wall opposite a second side wall, the cabinet box further having a face frame defining a cabinet opening and a first side portion opposite a second side portion; a linkage frame with a frame opening defined by a frame top opposite a frame bottom and a first frame side opposite a second frame side; a first hinge rotatably coupling the first frame side of the linkage frame to the first side portion of the cabinet box enabling the linkage frame to selectively rotate away from and towards proximity to the face frame; a cabinet door having a mirrored front face opposite a back face and a first door side opposite a second door side; and a second hinge rotatably coupling the second door side of the cabinet door to the second frame side of the linkage frame enabling the cabinet door to selectively rotate away from and towards proximity to the linkage frame, the second hinge being mounted to the linkage frame opposite the first hinge.
2. The wall cabinet of embodiment 1, wherein in a closed configuration, the second frame side of the linkage frame is substantially proximal to the second side portion of the cabinet box and the second door side of the cabinet door is substantially proximal to the second frame side of the linkage frame.
3. The wall cabinet of embodiments 1 or 2, wherein a first catch mechanism selectively holds the second frame side of the linkage frame substantially proximal to the second side portion of the cabinet box, and a second catch mechanism selectively holds the first door side of the cabinet door substantially proximal to the first frame side of the linkage frame.
4. The wall cabinet of any one of embodiments 1-3, wherein in a first open configuration, the second frame side of the linkage frame is substantially proximal to the second side portion of the cabinet box and the first door side of the cabinet door is rotated away from the first frame side of the linkage frame.
5. The wall cabinet of any one of embodiments 1-4, wherein in the first open configuration, the interior space of the cabinet box is accessible through the frame opening of the linkage frame.
6. The wall cabinet of any one of embodiments 1-5, wherein in a second open configuration, the second frame side of the linkage frame is rotated away from the second side portion of the cabinet box and the first door side of the cabinet door is rotated away from the first frame side of the linkage frame.
7. The wall cabinet of any one of embodiments 1-6, wherein in the second open configuration, the cabinet door and second hinge are positioned away from the face frame.
8. The wall cabinet of any one of embodiments 1-7, wherein in a third open configuration, the second frame side of the linkage frame is rotated away from the second side portion of the cabinet box and the first door side of the cabinet door is substantially proximal to the first frame side of the linkage frame.
9. The wall cabinet of any one of embodiments 1-8, in the third open configuration, the interior space of the cabinet box is accessible through the cabinet opening of the cabinet box.
10. The wall cabinet of any one of embodiments 1-9, wherein the linkage frame further comprises an offset step feature surrounding the frame opening to increase rigidity of the linkage frame.
11. The wall cabinet of any one of embodiments 1-10, wherein the back face of the cabinet door includes a recessed portion for receiving therein the offset step feature of the linkage frame when in the closed position and the third open configuration.
12. A wall cabinet comprising a cabinet box with a cabinet opening for access into an interior space and a first side portion opposite a second side portion; a linkage frame with a first frame side opposite a second frame side; a first hinge rotatably coupling the first frame side of the linkage frame to the first side portion of the cabinet box enabling the linkage frame to selectively rotate away from and towards proximity to the cabinet box; a cabinet door having a front face opposite a back face and a first door side opposite a second door side; and a second hinge rotatably coupling the second door side of the cabinet door to the second frame side of the linkage frame enabling the cabinet door to selectively rotate away from and towards proximity to the linkage frame, the second hinge being mounted to the linkage frame opposite the first hinge.
13. The wall cabinet of embodiment 12, wherein the linkage frame further includes a frame opening defined by the first frame side, the second frame side, a frame top, and a frame bottom opposite the frame top.
14. The wall cabinet of embodiments 12 or 13, wherein in a closed configuration, the second frame side of the linkage frame is substantially proximal to the second side portion of the cabinet box and the first door side of the cabinet door is substantially proximal to the first frame side of the linkage frame.
15. The wall cabinet of any one of embodiments 12-14, wherein a first catching mechanism selectively holds the second frame side of the linkage frame substantially proximal to the second side portion of the cabinet box, and a second catching mechanism selectively holds the first door side of the cabinet door substantially proximal to the first frame side of the linkage frame.
16. The wall cabinet of any one of embodiments 12-15, wherein in a first open configuration, the second frame side of the linkage frame is substantially proximal to the second side portion of the cabinet box and the first door side of the cabinet door is rotated away from the first frame side of the linkage frame.
17. The wall cabinet of any one of embodiments 12-16, wherein in a first open configuration, the second frame side of the linkage frame is substantially proximal to the second side portion of the cabinet box and the first door side of the cabinet door is rotated away from the first frame side of the linkage frame, when in the first open configuration, the interior space of the cabinet box is accessible through the frame opening of the linkage frame.

18. The wall cabinet of any one of embodiments 12-17, wherein in a second open configuration, the second frame side of the linkage frame is rotated away from the second side portion of the cabinet box and the first door side of the cabinet door is rotated away from the first frame side of the linkage frame, when in the second open configuration, the cabinet door and second hinge are positioned away from the face frame.
19. The wall cabinet of any one of embodiments 12-18, wherein in a third open configuration, the second frame side of the linkage frame is rotated away from the second side portion of the cabinet box and the first door side of the cabinet door is substantially proximal to the first frame side of the linkage frame.
20. The wall cabinet of any one of embodiments 12-19, wherein the linkage frame further comprises an offset step feature surrounding the frame opening to increase rigidity of the linkage frame, and the back face of the cabinet door includes a recessed portion for receiving therein the offset step feature of the linkage frame when in the closed position and the third open configuration.
21. The wall cabinet of any one of embodiments 12-20, wherein the front face of the cabinet door is a mirrored front face with an edge portion configured to permit passage of light therethrough, the wall cabinet further comprising a light source mounted within a light channel formed within the cabinet door, the edge portion of the mirrored front face is configured to at least partially overlay the light channel and permit passage of at least some light emitted by the light source through the edge portion.

In closing, foregoing descriptions of embodiments of the present invention have been presented for the purposes of illustration and description. It is to be understood that, although aspects of the present invention are highlighted by referring to specific embodiments, one skilled in the art will readily appreciate that these described embodiments are only illustrative of the principles comprising the present invention. As such, the specific embodiments are not intended to be exhaustive or to limit the invention to the precise forms disclosed. Therefore, it should be understood that embodiments of the disclosed subject matter are in no way limited to a particular element, compound, composition, component, article, apparatus, methodology, use, protocol, step, and/or limitation described herein, unless expressly stated as such.

In addition, groupings of alternative embodiments, elements, steps and/or limitations of the present invention are not to be construed as limitations. Each such grouping may be referred to and claimed individually or in any combination with other groupings disclosed herein. It is anticipated that one or more alternative embodiments, elements, steps and/or limitations of a grouping may be included in, or deleted from, the grouping for reasons of convenience and/or patentability. When any such inclusion or deletion occurs, the specification is deemed to contain the grouping as modified, thus fulfilling the written description of all Markush groups used in the appended claims.

Furthermore, those of ordinary skill in the art will recognize that certain changes, modifications, permutations, alterations, additions, subtractions, and sub-combinations thereof can be made in accordance with the teachings herein without departing from the spirit of the present invention. Furthermore, it is intended that the following appended claims and claims hereafter introduced are interpreted to include all such changes, modifications, permutations, alterations, additions, subtractions, and sub-combinations as are within their true spirit and scope. Accordingly, the scope of the present invention is not to be limited to that precisely as shown and described by this specification.

Certain embodiments of the present invention are described herein, including the best mode known to the inventors for conducting the invention. Of course, variations on these described embodiments will become apparent to those of ordinary skill in the art upon reading the foregoing description. The inventor expects skilled artisans to employ such variations as appropriate, and the inventors intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

The words, language, and terminology used in this specification is for the purpose of describing particular embodiments, elements, steps and/or limitations only and is not intended to limit the scope of the present invention, which is defined solely by the claims. In addition, such words, language, and terminology are to be understood not only in the sense of their commonly defined meanings, but to include by special definition in this specification structure, material or acts beyond the scope of the commonly defined meanings. Thus, if an element, step or limitation can be understood in the context of this specification as including more than one meaning, then its use in a claim must be understood as being generic to all possible meanings supported by the specification and by the word itself.

The definitions and meanings of the elements, steps or limitations recited in a claim set forth below are, therefore, defined in this specification to include not only the combination of elements, steps or limitations which are literally set forth, but all equivalent structure, material or acts for performing substantially the same function in substantially the same way to obtain substantially the same result. In this sense it is therefore contemplated that an equivalent substitution of two or more elements, steps and/or limitations may be made for any one of the elements, steps or limitations in a claim set forth below or that a single element, step, or limitation may be substituted for two or more elements, steps and/or limitations in such a claim. Although elements, steps or limitations may be described above as acting in certain combinations and even initially claimed as such, it is to be expressly understood that one or more elements, steps and/or limitations from a claimed combination can in some cases be excised from the combination and that the claimed combination may be directed to a sub-combination or variation of a sub-combination. As such, notwithstanding the fact that the elements, steps and/or limitations of a claim are set forth below in a certain combination, it must be expressly understood that the invention includes other combinations of fewer, more, or different elements, steps and/or limitations, which are disclosed in above combination even when not initially claimed in such combinations. Furthermore, insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. Accordingly, the claims are thus to be understood to include what is specifically illustrated and described above, what is conceptually equivalent, what can be obviously substituted and also what essentially incorporates the essential idea of the invention.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. For instance, as mass spectrometry instruments can vary slightly in determining the mass of a given analyte, the term "about" in the context of the mass of an ion or the mass/charge ratio of an ion refers to +/−0.50 atomic mass unit. At the very least, and not as an attempt to limit the application of the doctrine of equivalents to the scope of the claims, each numerical indication should at least be construed in light of the number of reported significant digits and by applying ordinary rounding techniques.

Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a comparable manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as, e.g., "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising", variations thereof such as, e.g., "comprise" and "comprises", and equivalent open-ended transitional phrases thereof like "including", "containing" and "having", encompass all the expressly recited elements, limitations, steps, integers, and/or features alone or in combination with unrecited subject matter; the named elements, limitations, steps, integers, and/or features are essential, but other unnamed elements, limitations, steps, integers, and/or features may be added and still form a construct within the scope of the claim. Specific embodiments disclosed herein may be further limited in the claims using the closed-ended transitional phrases "consisting of" or "consisting essentially of" (or variations thereof such as, e.g., "consist of", "consists of", "consist essentially of", and "consists essentially of") in lieu of or as an amendment for "comprising." When used in the claims, whether as filed or added per amendment, the closed-ended transitional phrase "consisting of" excludes any element, limitation, step, integer, or feature not expressly recited in the claims. The closed-ended transitional phrase "consisting essentially of" limits the scope of a claim to the expressly recited elements, limitations, steps, integers, and/or features and any other elements, limitations, steps, integers, and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps, integers, and/or features specifically recited in the claim, whereas the meaning of the closed-ended transitional phrase "consisting essentially of" is being defined as only including those elements, limitations, steps, integers, and/or features specifically recited in the claim and those elements, limitations, steps, integers, and/or features that do not materially affect the basic and novel characteristic(s) of the claimed subject matter. Therefore, the open-ended transitional phrase "comprising" (and equivalent open-ended transitional phrases thereof) includes within its meaning, as a limiting case, claimed subject matter specified by the closed-ended transitional phrases "consisting of" or "consisting essentially of." As such, the embodiments described herein or so claimed with the phrase "comprising" expressly and unambiguously provide description, enablement, and support for the phrases "consisting essentially of" and "consisting of."

Lastly, all patents, patent publications, and other references cited and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. The reference to any prior art in this specification is not, and should not be taken as, an acknowledgement or any form of suggestion that the prior art forms part of the common general knowledge from any country. In addition, nothing in this regard is or should be construed as an admission that the inventors are not entitled to antedate such disclosure by virtue of prior invention or for any other reason. All statements as to the date or representation as to the contents of these documents are based on the information available to the applicant and do not constitute any admission as to the correctness of the dates or contents of these documents.

The invention claimed is:

1. A wall cabinet comprising:

a cabinet box with an interior space defined by a back wall, a top wall opposite a bottom wall, and a first side wall opposite a second side wall, the cabinet box further having a face frame defining a cabinet opening and a first side portion opposite a second side portion;

a linkage frame with a frame opening defined by a frame top opposite a frame bottom and a first frame side opposite a second frame side, the frame top, the frame bottom, the first frame side, and the second frame side each being a rectangular strip of metal, the linkage frame comprising an offset step feature surrounding the frame opening to increase rigidity of the linkage frame;

a first hinge rotatably coupling the first frame side of the linkage frame to the first side portion of the cabinet box enabling the linkage frame to selectively rotate away from and towards proximity to the face frame;

a cabinet door having a front face opposite a back face, a first door side opposite a second door side, and a mirror, the cabinet door comprising a door frame that defines a mirror support face on the front face, wherein the mirror is non-moveably secured to the mirror support face, wherein the cabinet door is located in front of the linkage frame, and wherein the back face includes a recessed portion for receiving therein the offset step feature of the linkage frame; and a second hinge rotatably coupling the second door side of the cabinet door to the second frame side of the linkage frame enabling the cabinet door to selectively rotate away from and towards proximity to the linkage frame, the second hinge being mounted to the linkage frame opposite the first hinge, wherein, the wall cabinet can adopt a closed configuration, a first open configuration, a second open configuration, and a third open configuration;

wherein, in the closed configuration, the second frame side of the linkage frame is substantially proximal to the second side portion of the cabinet box, the first door side of the cabinet door is substantially proximal to the first frame side of the linkage frame, the recessed portion of the back face receives therein the offset step feature of the linkage frame, and the cabinet door conceals the linkage frame from view;

wherein, in the first open configuration, the second frame side of the linkage frame is substantially proximal to the second side portion of the cabinet box, the first door side of the cabinet door is rotated away from the first frame side of the linkage frame, and the interior space of the cabinet box is accessible through the frame opening of the linkage frame;

wherein, in the second open configuration, the second frame side of the linkage frame is rotated away from the second side portion of the cabinet box, the first door side of the cabinet door is rotated away from the first frame side of the linkage frame, and the interior space of the cabinet box is accessible through either the frame opening of the linkage frame or the cabinet opening of the cabinet box; and wherein, in the third open configuration, the second frame side of the linkage frame is rotated away from the second side portion of the cabinet box, the first door side of the cabinet door is substantially proximal to the first frame side of the linkage frame, the recessed portion of the back face receives therein the offset step feature of the linkage frame, and the interior space of the cabinet box is accessible through the cabinet opening of the cabinet box.

2. The wall cabinet of claim 1, wherein a first catch mechanism selectively holds the second frame side of the linkage frame substantially proximal to the second side portion of the cabinet box.

3. The wall cabinet of claim 1, wherein a second catch mechanism selectively holds the first door side of the cabinet door substantially proximal to the second frame side of the linkage frame.

4. The wall cabinet of claim 1, wherein the wall cabinet further comprises a light source mounted within a light channel formed within the cabinet door.

5. The wall cabinet of claim 4, wherein the mirror has an edge portion configured to at least partially overlay the light channel and permit passage of at least some light emitted by the light source through the edge portion.

6. The wall cabinet of claim 5, wherein the edge portion of the mirror affects a diffusion quality of the at least some light emitted by the light source, a color temperature of the at least some light emitted by the light source, or a luminosity of the at least some light emitted by the light source.

7. The wall cabinet of claim 4, wherein an interior surface of the light channel has a colored surface or a reflective surface.

8. The wall cabinet of claim 4, wherein the light source is a light emitting diode.

9. The wall cabinet of claim 1, wherein, in the second open configuration, the cabinet door and second hinge are positioned away from the face frame.

10. A wall cabinet comprising:

a cabinet box with a cabinet opening for access into an interior space and a first side portion opposite a second side portion;

a linkage frame, the linkage frame being a strip of metal that defines a frame opening for access into the interior space of the cabinet box, the linkage frame having a first frame side opposite a second frame side and an offset step feature surrounding the frame opening to increase rigidity of the linkage frame;

a first hinge rotatably coupling the first frame side of the linkage frame to the first side portion of the cabinet box enabling the linkage frame to selectively rotate away from and towards proximity to the cabinet box;

a cabinet door having a front face opposite a back face, a first door side opposite a second door side, and a mirror, the cabinet door comprising a door frame that defines a mirror support face on the front face, wherein the mirror is non-moveably secured to the mirror support face, wherein the cabinet door is located in front of the linkage frame, and wherein the back face includes a recessed portion for receiving therein the offset step feature of the linkage frame;

a second hinge rotatably coupling the second door side of the cabinet door to the second frame side of the linkage frame enabling the cabinet door to selectively rotate away from and towards proximity to the linkage frame, the second hinge being mounted to the linkage frame opposite the first hinge;

wherein the wall cabinet can adopt a closed configuration, a first open configuration, a second open configuration, and a third open configuration;

wherein, in the closed configuration, the second frame side of the linkage frame is substantially proximal to the second side portion of the cabinet box, the first door side of the cabinet door is substantially proximal to the first frame side of the linkage frame, the recessed portion of the back face receives therein the offset step feature of the linkage frame, and the cabinet door conceals the linkage frame from view;

wherein, in the first open configuration, the second frame side of the linkage frame is substantially proximal to the second side portion of the cabinet box, the first door side of the cabinet door is rotated away from the first frame side of the linkage frame, and the interior space of the cabinet box is accessible through the frame opening of the linkage frame;

wherein, in the second open configuration, second frame side of the linkage frame is rotated away from the second side portion of the cabinet box and the first door side of the cabinet door is rotated away from the first frame side of the linkage frame, and the interior space of the cabinet box is accessible through either the frame opening of the linkage frame or the cabinet opening of the cabinet box; and wherein, in the third open configuration, the second frame side of the linkage frame is rotated away from the second side portion of the cabinet box, the first door side of the cabinet door is substantially proximal to the first frame side of the linkage frame, the recessed portion of the back face receives therein the offset step feature of the linkage frame, and the interior space of the cabinet box is accessible through the cabinet opening of the cabinet box.

11. The wall cabinet of claim 10, wherein the linkage frame further includes a frame top and a frame bottom opposite the frame top.

12. The wall cabinet of claim 11, wherein the cabinet door has a circular shape, an oval shape, a rectangular shape, or a shape with arced edges.

13. The wall cabinet of claim 11, wherein the linkage frame has a circular shape, an oval shape, a rectangular shape, or a shape with arced edges.

14. The wall cabinet of claim 10, wherein a first catching mechanism selectively holds the second frame side of the linkage frame substantially proximal to the second side portion of the cabinet box.

15. The wall cabinet of claim 10, wherein a second catching mechanism selectively holds the first door side of the cabinet door substantially proximal to the first frame side of the linkage frame.

16. The wall cabinet of claim 10, wherein the linkage frame has a circular shape, an oval shape, a rectangular shape, or a shape with arced edges.

17. The wall cabinet of claim 10, wherein the cabinet door has a circular shape, an oval shape, a rectangular shape, or a shape with arced edges.

18. The wall cabinet of claim 10, wherein the wall cabinet further comprises a light source mounted within a light channel formed within the cabinet door, and an edge portion of the mirror is configured to at least partially overlay the light channel and permit passage of at least some light emitted by the light source through the edge portion.

* * * * *